US006392211B2

(12) United States Patent
Kim et al.

(10) Patent No.: US 6,392,211 B2
(45) Date of Patent: May 21, 2002

(54) CONVECTION DEVICE OF MICROWAVE OVEN

(75) Inventors: Seog Tae Kim, Changwon; Geun Hyoung Lee, Busan; Kwang Ok Kang, Changwon, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/740,265

(22) Filed: Dec. 19, 2000

(30) Foreign Application Priority Data

Dec. 20, 1999 (KR) ..... 99-59512

(51) Int. Cl.[7] ..... H05B 6/80

(52) U.S. Cl. ..... 219/681; 219/400; 219/757; 126/21 A

(58) Field of Search ..... 219/681, 685, 219/682, 683, 757, 751, 754, 400, 401; 126/21 A

(56) References Cited

U.S. PATENT DOCUMENTS 3,692,968 A * 9/1972 Yasuoka ..... 219/681
4,409,453 A 10/1983 Smith
4,439,459 A * 3/1984 Swartley ..... 126/21 A
4,559,903 A * 12/1985 Bloom et al. ..... 119/19
4,714,811 A * 12/1987 Gerling et al. ..... 219/751
4,865,169 A 9/1989 Rachels et al.
5,367,739 A 11/1994 Johnson
5,379,684 A * 1/1995 Ettridge ..... 99/336
5,401,940 A 3/1995 Smith et al.
5,483,044 A * 1/1996 Thorneywork et al. ..... 219/681
5,859,540 A * 1/1999 Fukumoto ..... 126/21 A

FOREIGN PATENT DOCUMENTS

JP 56-12934 * 2/1981 ..... 126/21 A

* cited by examiner

*Primary Examiner*—Philip H. Leung
(74) *Attorney, Agent, or Firm*—Ostrolenk, Faber, Gerb & Soffen, LLP

(57) ABSTRACT

The present invention relates to a convection device of a microwave oven comprises a heater chamber formed on the out-side surface of a cooking chamber, a fan housing installed inside of the heater chamber so as to be rotational within a predetermined rotation range including an inlet hole where the air inside of the heater chamber flows into and a discharging port for providing the air into the cooking chamber, and a fan installed inner side of the fan housing for generating air flow provided into the cooking chamber through the discharging port. Accordingly, the present invention can provide the heated-air uniformity to the each portion inside of the cooking chamber.

6 Claims, 3 Drawing Sheets

CONVECTION DEVICE OF MICROWAVE OVEN

BACKGROUND OF THE INVENTION

1. Field of the Invention

The present invention relates to a microwave oven including a heater, in particular to a convection device of a microwave oven which is capable of providing the heat generated from a heater uniformly inside of a cooking chamber.

2. Description of the Prior Art

A microwave oven heats a heating object by using microwave. In recent years, in order to add more various heating function to the microwave oven, the heater is installed as the other heating source besides the microwave, and the heat generated by the heater is used for heating the heating object.

FIG. 1 illustrates the conventional microwave oven including the heater as the heating source besides the microwave. As depicted in FIG. 1, a heater chamber 4 is formed on the external upper portion of a cooking chamber 2, and heaters 6*a*, 6*b* are installed inside of the heater chamber 4.

A fan 10 is installed on the center portion of the heater chamber 4, the fan 10 is rotated by a motor M installed on the upper portion of the heater chamber 4. A sucking portion 8 and discharging portion 9*a*, 9*b* are formed on the upper surface of the cooking chamber 2 corresponding to the bottom surface of the heater chamber 4 in order to circulate air by the fan 10.

In more detail, the sucking portion 8 is formed on the lower center portion of the fan 10 in order to suck the air inside of the cooking chamber 2, and the discharging portion 9*a*, 9*b* are formed on the portion corresponding to the lower edge of the fan 10 in order to provide the air sucked through the sucking portion 8 to the inside of the cooking chamber 2.

In the conventional microwave oven, when the heating is performed by the heater 6*a*, 6*b*, the fan 10 operates at the same time with the heat generation of the heater 6*a*, 6*b* to which power has been applied. The air sucked from the cooking chamber 2 by the sucking portion 8 according to the operation of the fan 10 is heated while circulating inside of the heater chamber 4 and passing through the heater 6*a*, 6*b*, and is flowed into the cooking chamber 2 through the discharge portion 9*a*, 9*b*.

However, the conventional convection heating type microwave oven has below problems.

In the heat convection, the heated-air circulating inside of the heater chamber 4 and cooking chamber 2 can not circulate sufficiently inside of the cooking chamber 2 while flowing through the sucking portion 8 on the center portion and the discharge portion 9*a*, 9*b* on the edge. In other words, the circulation of the heated-air is even on the upper center portion of the cooking chamber 2 adjacent to the fan 10, but the circulation of the heated-air on the lower portion such as a corner portion is not even.

In the heat convection of the convection heating type microwave oven, because the air-flow is generated by sucking the air on the center portion and using the centrifugal force of the fan 10 downwardly fixed, the appropriate air-flow for transmitting the heat to the overall cooking chamber 2 can not be generated. Accordingly, the foodstuff can not be uniformly heated because the conventional convection heating type microwave oven can not uniformly distribute the heat.

And, the air provided through the discharge portion 9*a*, 9*b* is the heated-air heated through the heat-exchange with the heater 6*a*, 6*b*, when the heated-air is provided to the inside of the cooking chamber 2, the heated-air contacts first with a side surface of the cooking chamber 2, accordingly the temperature of the heated-air lowers due to the heat loss. In other words, the heat transmission efficiency with the foodstuff lowers because the heat of the air is taken away to the side wall surface by contacting it first.

SUMMARY OF THE INVENTION

The object of the present invention is to provide a convection device of a microwave oven which is capable of transmitting uniformly the heat generated from a heater to each part inside of a cooking chamber.

The other object of the present invention is to provide the convection device of the microwave oven which is capable of providing selectively the heat generated from the heater to a predetermined portion inside of the cooking chamber.

In order to achieve the objects, the convection device of the present invention comprises a heater chamber installed on the side wall surface of the cooking chamber, a fan housing installed inside of the heater chamber so as to be rotational within a predetermined rotation range including an inlet hole where the air inside of the heater chamber flows into and a discharging port for providing the air into the cooking chamber, and a fan installed inner side surface of the fan housing for generating the air-flow provided inside of the cooking chamber through a discharging port.

DETAILED DESCRIPTION OF THE PREFERRED EMBODIMENT

Hereinafter, the embodiment of a convection device of a microwave oven according to the present invention will now be described with reference to accompanying drawings.

Figure 1:
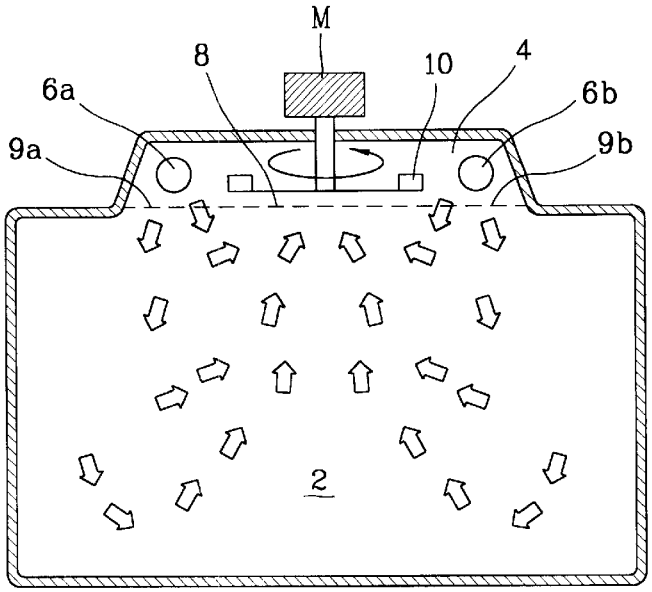
FIG. 1 CONVENTIONAL ART
FIG. 1 is a sectional view illustrating the construction of a conventional convection device.
Figure 2:
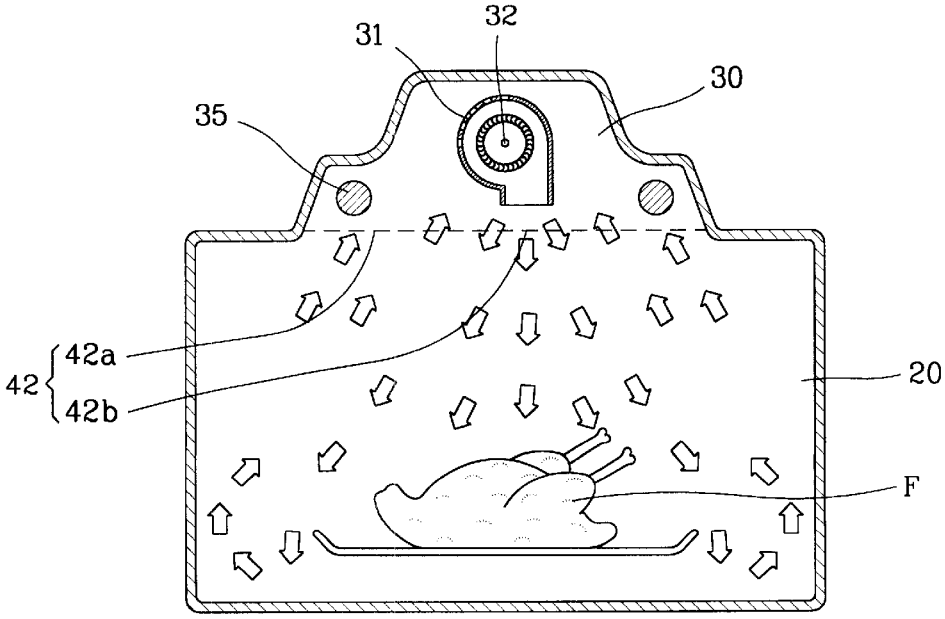
FIG. 2 is a sectional view illustrating the construction of a convection device according to the present invention.

As depicted in FIG. 2, a heater chamber 30 is formed on the out-side surface of a cooking chamber 20 of the microwave oven according to the present invention.

A fan 32 and a heater 35 as a heating source are installed inside of the heater chamber 30. The heat generated from the heater 35 is provided inside of the cooking chamber 20 through the airflow by the fan 32. It is possible to construct a pair of straight shape heaters or one U-shaped bending heater as the heater 35.

An inlet/outlet portion 42 for sucking or discharging the air to the cooking chamber 20 is formed on the lower side surface of the heater chamber 30 installed on the upper surface of the cooking chamber 20, the inlet/outlet portion 42 is generally constructed as a mesh-net or a plate having a plurality of air through hole.

As depicted in FIG. 2, when the fan housing 31 is downwardly placed, the inlet/outlet portion 42 is constructed with a discharging portion 42*a* for providing downwardly the high temperature air to the cooking chamber 20, and a sucking portion 42*b* for sucking the low temperature air performed the heat transmission inside of the cooking chamber 20 to the inside of the heater chamber 30.

The inlet/outlet portion 42 connects the inside of the heater chamber 30 to the cooking chamber 20 to be ventilated.

Figure 3A:
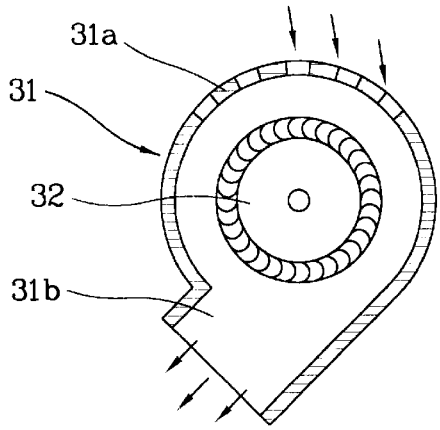
FIGS. 3A is a sectional view illustrating the operation of a fan housing according to the present invention.
Figure 3B:
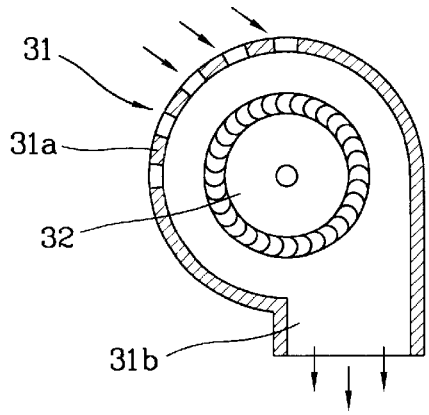
FIG. 3B is a sectional view illustrating the operation of a fan housing according to the other embodiment of the present invention.
Figure 3C:
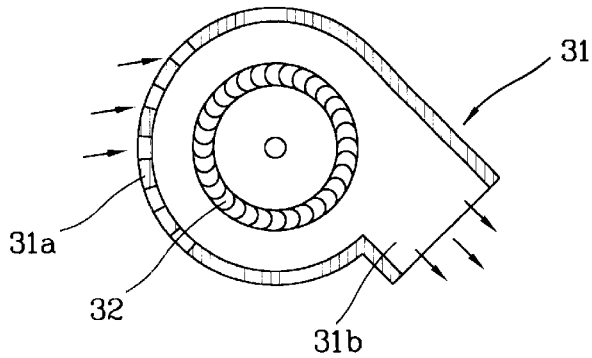
FIG. 3C is a sectional view illustrating the operation of a fan housing according to the another embodiment of the present invention.

As depicted in FIGS. 3A, 3B, 3C, the fan housing 31 is installed so as to be rotational within a predetermined rotation range. In addition, the rotating angle range of the fan housing 31 can be controlled according to type or amount of the foodstuff. Accordingly, a discharging port 31*b* of the fan housing 31 rotates to the left or center or right directions inside of the cooking chamber 20. Likewise, it is possible to provide uniformly the heated-air to the each portion inside of the cooking chamber 20 by installing the fan housing 31 to be rotational.

The structure of the fan housing 31 according to the present invention will now be described.

Figure 4:
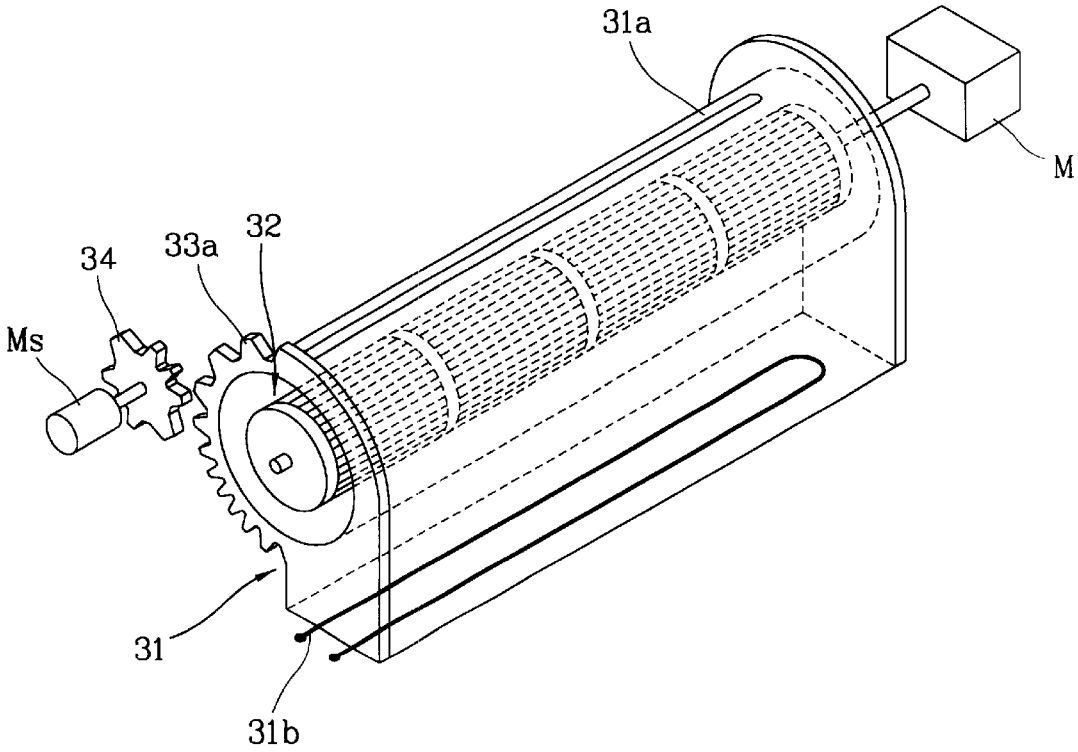
FIG. 4 is a perspective view illustrating the construction of a fan housing according to the present invention.

As depicted in FIG. 4, a rack gear unit 33 is formed on the outer side of the fan housing 31. As depicted in FIG. 3, a rack gear 33*a* of the rack gear unit 33 rotates within a predetermined rotation range according to direct or reverse rotation of an driving gear 34 by meshing with an driving gear 34. The driving gear 34 is connected to an output shaft of a stepping motor Ms that can rotate to the direct or reverse rotation.

And, an inlet hole 31*a* where the outer air flows into the fan housing is formed on the upper portion of the fan housing 31, and a discharging port 31*b* for discharging the air inside of the cooking chamber 20 is formed on the lower portion of the fan housing 31. The air flowed into the fan housing 31 through the inlet hole 31*a* is the heated-air which made of the heat exchange between the heater 35.

A non-described reference numeral M of FIG. 4 is an operating motor for rotating the fan 32 according to the present invention. And, in the present invention, a radial-flow flow fan is used as the fan 32, but the present invention is not limited by that.

Hereinafter, the overall operating relation of the convection device according to the present invention will now be described.

When the power is applied to the heater 35, the heater 35 heats and at the same time the fan 32 rotates and generates the airflow. In addition, when the power is applied to the stepping motor Ms, the stepping motor Ms performs the direct and reverse rotation within the predetermined rotation range.

The air flow generated according to the rotation of the fan 32 is discharged through the discharging port 31*b* formed on the lower portion of the fan housing 31, after passing the inlet hole 31*a* formed on the upper portion of the fan housing 31, passes through the inlet/outlet portion 42, and is provided inside of the cooking chamber 20.

In addition, at the same time the driving gear 34 repeats the direct or reverse rotation within the predetermined rotation range by operating of the stepping motor Ms, as depicted in FIGS. 3A, 3B, 3C, the fan housing 31 is rotated repeatedly within the predetermined rotation range. And the heated-air flowed into the cooking chamber 20 can be provided uniformly to each portion of the cooking chamber 20, accordingly the uniform temperature distribution is performed.

And, the heated-air flowed into the cooking chamber 20 by the fan housing 31 performs the heat exchange while contacting with the foodstuff F, the low temperature air which is altered from the heated-air flows again into the heat chamber 30 through the inlet/outlet portion 42 after passing the other wall surface of the cooking chamber 20.

The low temperature air flowed into the heater chamber 30 is re-heated by the heater 35, and is provided into the cooking chamber 20 through the fan housing 31.

In the other embodiment of the present invention, it is possible to provide concentrically the heated-air to the selected portion inside of the cooking chamber 20 by using the fan housing 31. And, it is possible also to adapt the convection device of the microwave oven according to the present invention to a general cooking oven for cooking oven for cooking the foodstuff.

As described above, the convection device of the microwave oven according to the present invention is capable of providing uniformly the heated-air inside of the cooking chamber 20 by rotating the fan housing, and providing concentrically the heated-air to the predetermined portion, accordingly the microwave oven according to the present invention is convenient to use. In addition, the convection device of the microwave oven according to the present invention is capable of controlling the rotating range of the fan housing 31 in accordance with the type or amount of the foodstuff, accordingly the foodstuff can be cooked uniformly and the cooking speed can be improved.

In addition, the heated-air provided into the cooking chamber 20 through the fan housing 31 contacts first with the foodstuff, and is sucked through the side wall of the cooking chamber 20, accordingly the heat loss which is transmitted to the outside of the cooking chamber 20 can be minimized. In addition, the efficiency of the energy consumption and quality of the dish cooked by using the convection device of the microwave oven according to the present invention can be improved by using the heat efficiently and reducing the cooking time.

What is claimed is:

1. A convection device for and in combination with a microwave oven, comprising:

a heater chamber defined by a side wall surface of a cooking chamber of the microwave oven;

a heater installed inside the heater chamber;

a fan housing installed inside of the heater chamber so as to be rotatable within a predetermined rotation range and including an inlet hole into which air inside of the heater chamber may flow and a discharging port for providing the air into the cooking chamber, wherein as the fan housing rotates within said rotation range, the discharging port of the fan housing is rotated therewith; and a fan installed inside of the fan housing for generating an airflow into the cooking chamber through the discharging port.

2. The convection device according to claim 1, wherein the fan is a radial-flow fan, and further comprising a mechanism for rotating the fan housing within the predetermined rotation range.

3. The convection device according to claim 1, wherein a rack gear is formed on an outer surface of the fan housing.

4. The convection device according to claim 3, including a motor, and wherein the rack gear is formed to mesh with a driving gear of the motor.

5. The convection device according to claim 4, wherein the motor is a stepping motor.

6. The convection device according to claim 5, wherein the stepping motor can rotate to the direct and reverse a rotation direction thereof, and thus can rotate the fan housing within the predetermined rotation range.

* * * * *